US005497706A

United States Patent [19]

Yong

[11] Patent Number: 5,497,706

[45] Date of Patent: Mar. 12, 1996

[54] PORTABLE TABLE APPARATUS

[76] Inventor: Cheong Ah Yong, 817, Jalan Raja Muda, Pasir Pinji, 31650, Pioh, Perak, Malaysia

[21] Appl. No.: 275,261

[22] Filed: Jul. 15, 1994

[51] Int. Cl.[6] ..... F21V 33/00

[52] U.S. Cl. ..... 108/23; 108/26; 108/129; 248/439

[58] Field of Search ..... 108/23, 25, 26, 108/26.2, 44, 151, 129, 157, 159, 154, 42; 248/436, 439, 188.6; 312/231, 232; 206/562, 564; 220/351, 348

[56] References Cited

U.S. PATENT DOCUMENTS

| | | | |
|---|---|---|---|
| 354,566 | 12/1886 | Near | 108/157 X |
| 1,585,029 | 5/1926 | Guth | 312/232 X |
| 1,906,213 | 4/1933 | Neuschotz et al. | 108/25 |
| 1,949,493 | 3/1936 | Sengbusch | 108/26.2 |
| 3,432,132 | 3/1969 | Thurston | 108/154 X |
| 3,828,695 | 8/1974 | Skarky | 108/26 |
| 4,392,437 | 7/1983 | Wallace | 108/129 X |
| 4,654,762 | 3/1987 | Laverick | 108/23 X |
| 4,807,095 | 2/1989 | Bell | 108/23 X |
| 5,207,495 | 5/1993 | Ahlstone | 108/23 X |

*Primary Examiner*—Kenneth J. Dorner
*Assistant Examiner*—Janet M. Wilkens

[57] ABSTRACT

A portable table includes a top surface having a plurality of compartments positioned within a removable block member permitting ease of cleaning and maintenance of the block and the compartments therewithin, and includes pivotally mounted legs mounted to a bottom wall of the table, wherein pairs of the legs are arranged for interconnection to optionally employ a tensioning structure to maintain the legs in an orthogonal relationship relative to the bottom wall.

5 Claims, 5 Drawing Sheets

PORTABLE TABLE APPARATUS

BACKGROUND OF THE INVENTION

1. Field of the Invention

The field of invention relates to table structure, and more particularly pertains to a new and improved portable table apparatus wherein the same is arranged for the ease of use relative to an individual at various selected positions.

2. Description of the Prior Art

The prior art such as indicated in U.S. Pat. No. 4,974,526 indicates a portable table structure arranged for collapsing for storage, wherein U.S. Pat. No. 5,054,736 indicates a lap-top table structure.

The instant invention attempts to overcome deficiencies of the prior art by providing a compact table member arranged for ease of use as well as effectiveness in construction and in this respect, the present invention substantially fulfills this need.

SUMMARY OF THE INVENTION

In view of the foregoing disadvantages inherent in the known types of portable table apparatus now present in the prior art, the present invention provides a portable table apparatus wherein the same includes foldable legs arranged for selective extension relative to the table structure. As such, the general purpose of the present invention, which will be described subsequently in greater detail, is to provide a new and improved portable table apparatus which has all the advantages of the prior art portable table apparatus and none of the disadvantages.

To attain this, the present invention provides a portable table including a top surface having a plurality of compartments positioned within a removable block member permitting ease of cleaning and maintenance of the block and compartments therewithin, and including pivotally mounted legs mounted to a bottom wall of the table, wherein pairs of the legs are arranged for interconnection to optionally employ a tensioning structure to maintain the legs in an orthogonal relationship relative to the bottom wall.

The invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable table apparatus which has all the advantages of the prior art portable table apparatus and none of the disadvantages.

It is another object of the present invention to provide a new and improved portable table apparatus which may be easily and efficiently manufactured and marketed.

It is a further object of the present invention to provide a new and improved portable table apparatus which is of a durable and reliable construction.

An even further object of the present invention is to provide a new and improved portable table apparatus which is susceptible of a low cost of manufacture with regard to both materials and labor, and which accordingly is then susceptible of low prices of sale to the consuming public, thereby making such portable table apparatus economically available to the buying public.

Still yet another object of the present invention is to provide a new and improved portable table apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

FIG. **4*a*** is an individual lock leg assembly, with the associated leg in a raised orientation.

FIG. **4*b*** is an isometric illustration of an individual lock leg assembly, with the individual leg in a lowered orientation.

Figure 5:
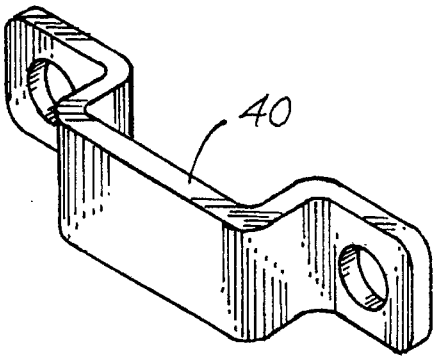

FIG. 5 is an isometric illustration of the U-shaped mounting plate for use by the invention.

Figure 6:
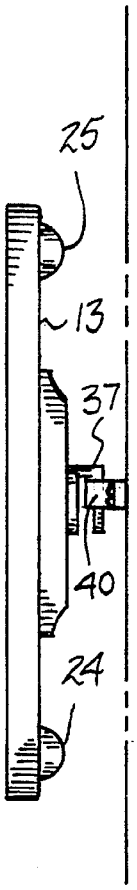

FIG. 6 is an orthographic side view of the mounting plate and the table secured thereto.

Figure 7:
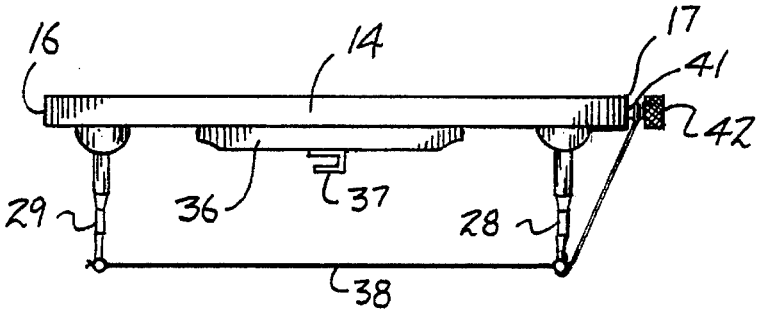

FIG. 7 is an orthographic side view of the invention including a tensioning structure for the tether members.

Figure 8:
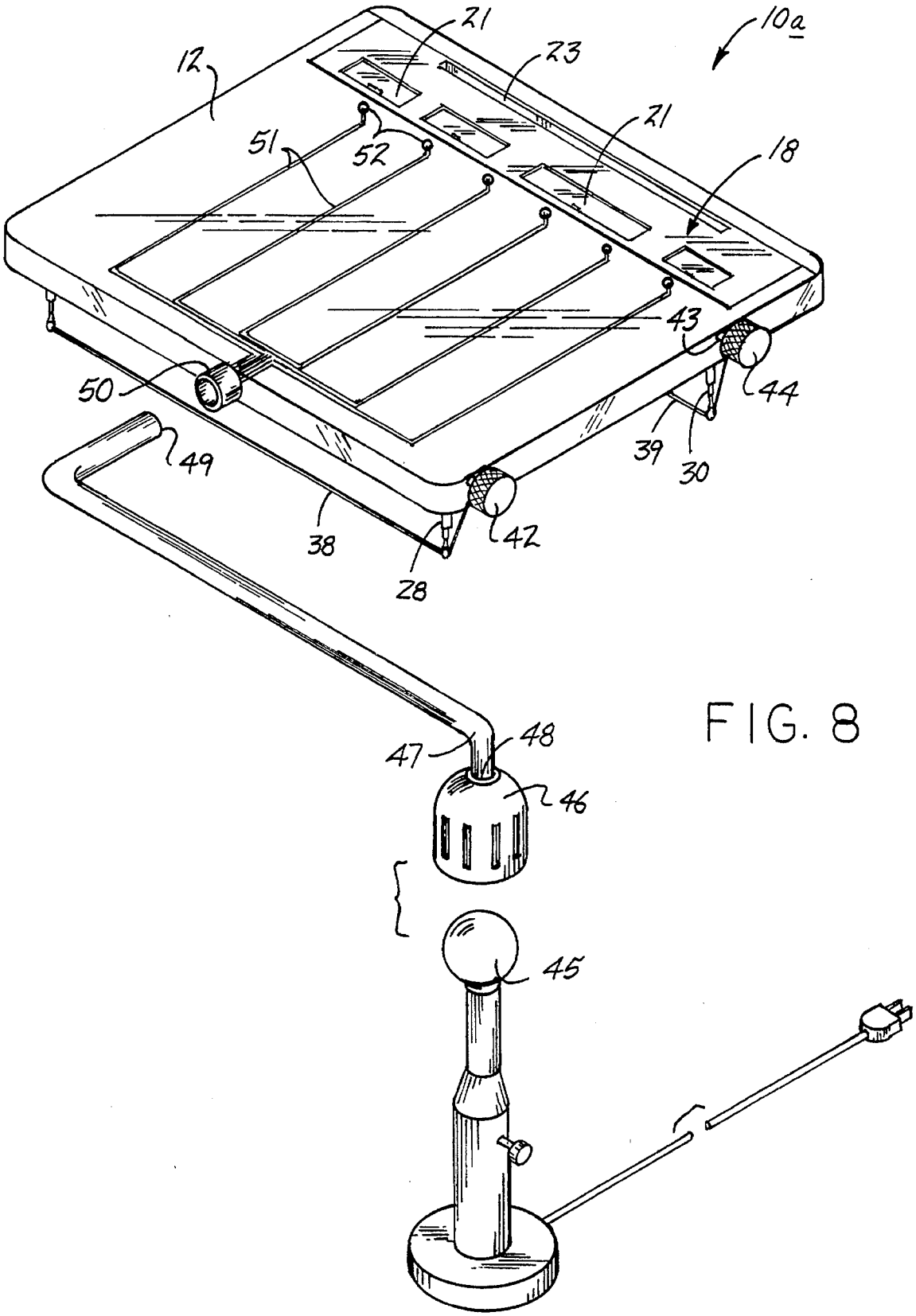

FIG. 8 is an isometric illustration of a modified aspect of the invention employing illuminated indicator structure for indication of the various storage pockets through the top wall.

DESCRIPTION OF THE PREFERRED EMBODIMENT

With reference now to the drawings, and in particular to FIGS. 1 to 8 thereof, a new and improved portable table apparatus embodying the principles and concepts of the present invention and generally designated by the reference numerals 10 and 10*a* will be described.

More specifically, the portable table apparatus 10 of the instant invention essentially comprises a rigid table plate 11 formed with a plate top wall 12 spaced from and parallel a plate bottom wall 13. A plate first end wall 14 is spaced from a plate second end wall 15, with a plate first side wall 16 spaced from a plate second side wall 17. A polymeric insert block of a parallelepiped configuration is complementarily received within a parallelepiped cavity 18*a* directed into the table plate through the plate top wall 12. Recessed portions 20 are directed into the block 18 through the block top wall 19 sliding door plates 21 all each slidably mounted within an individual door plate slot 22, with each door plate slot 22 parallel to and in adjacency to the insert block top wall 19. A ruler receiving slot 23 is directed into the block top wall for reception of a ruler and the like (not shown). It is understood that the block 18 is accordingly removably mounted relative to the cavity 18*a* for its maintenance, cleaning, and the like to permit ease of removal of debris accumulated within the recesses 20.

Figure 1:
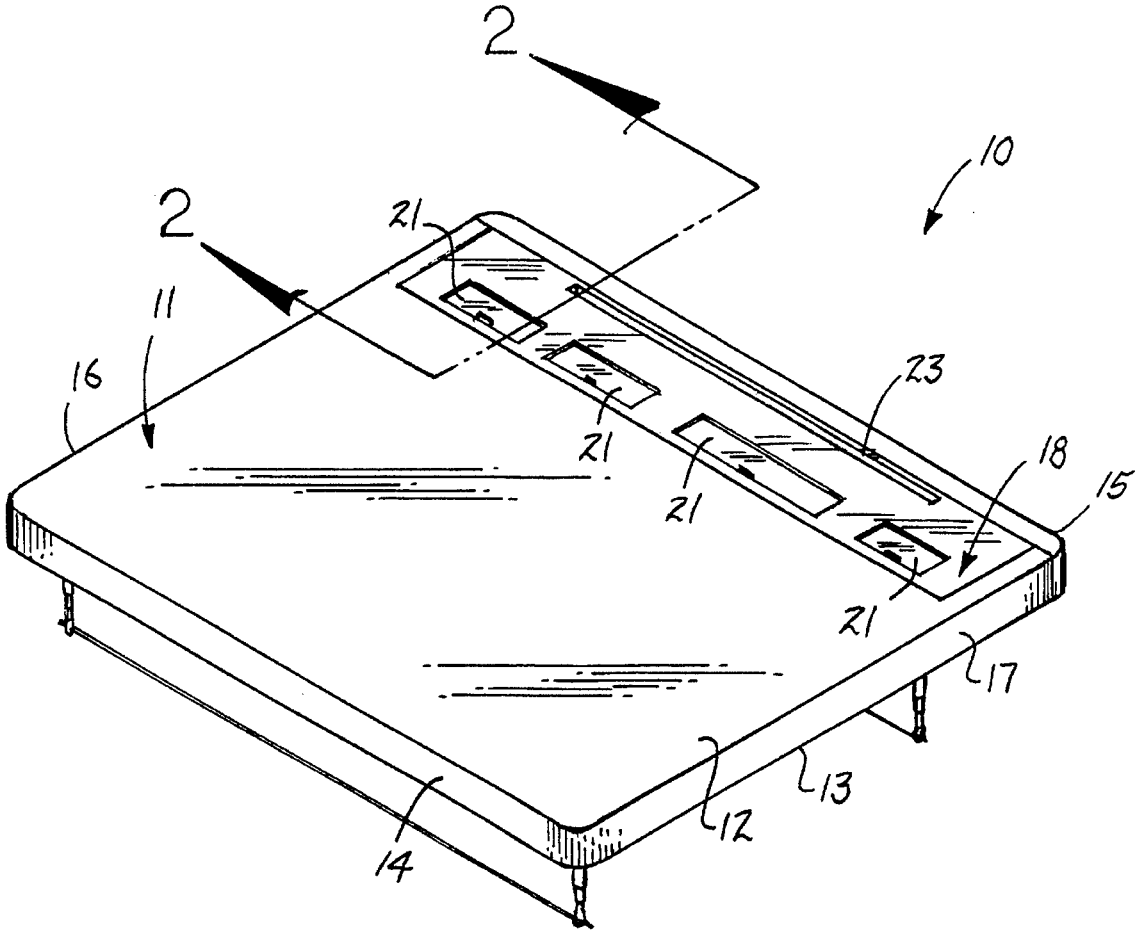
FIG. 1 an isometric illustration of the invention.
Figure 2:
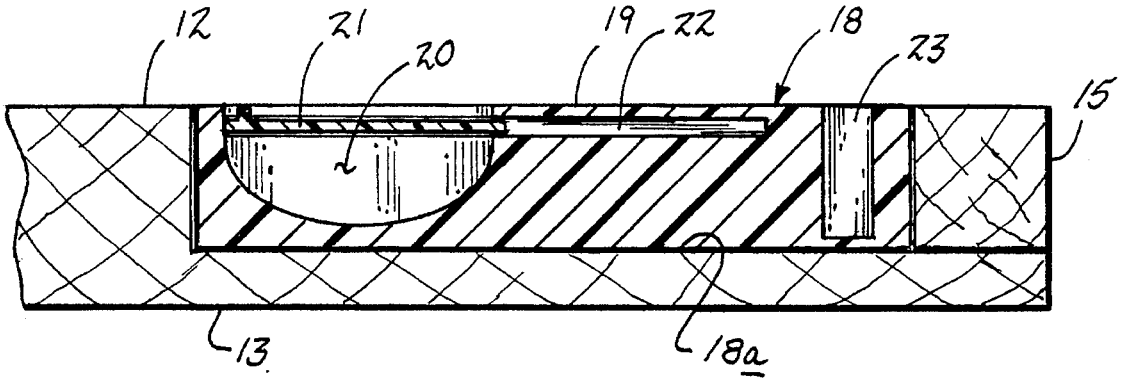
FIG. 2 is an orthographic view, taken along the lines 2—2 of FIG. 1 in the indicated by the arrows.
Figure 3:
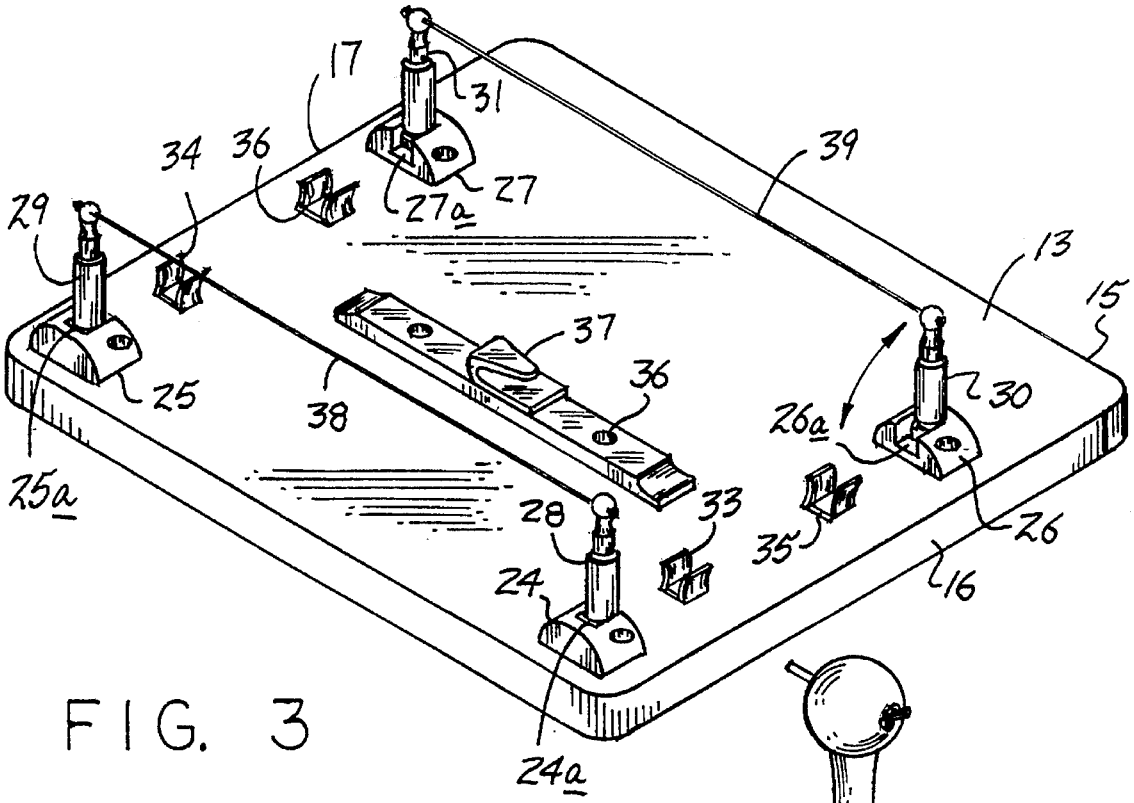
FIG. 3 is an isometric bottom view of the table structure.
Figure 4:
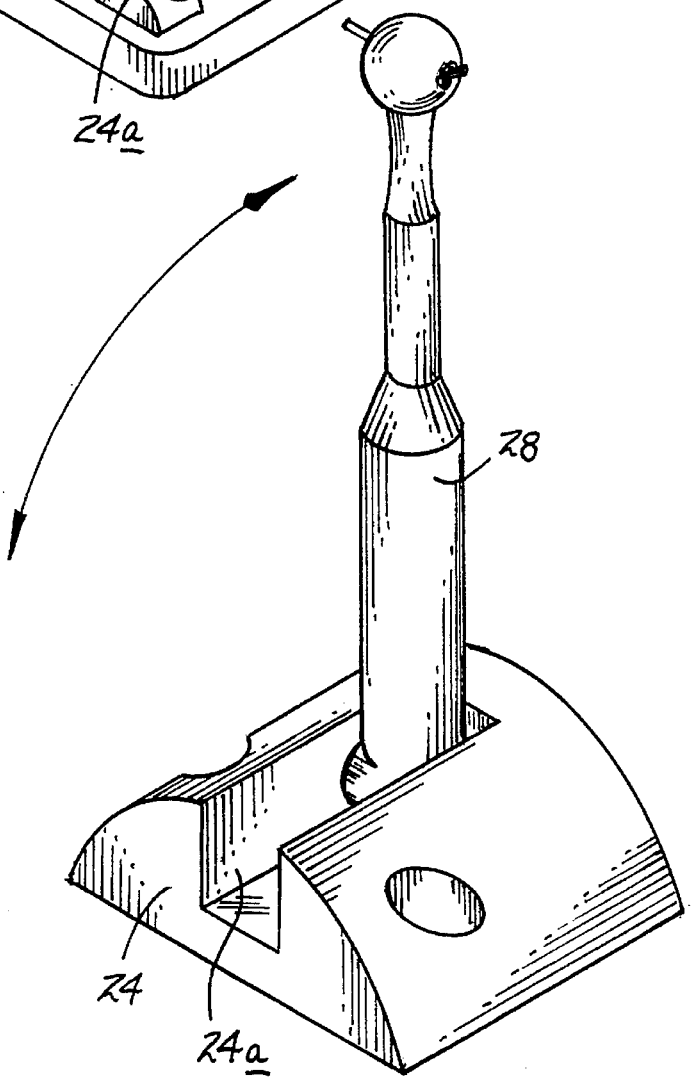
FIG. 4 is an isometric illustration of an individual leg and leg lock assembly.
Figure 4A:
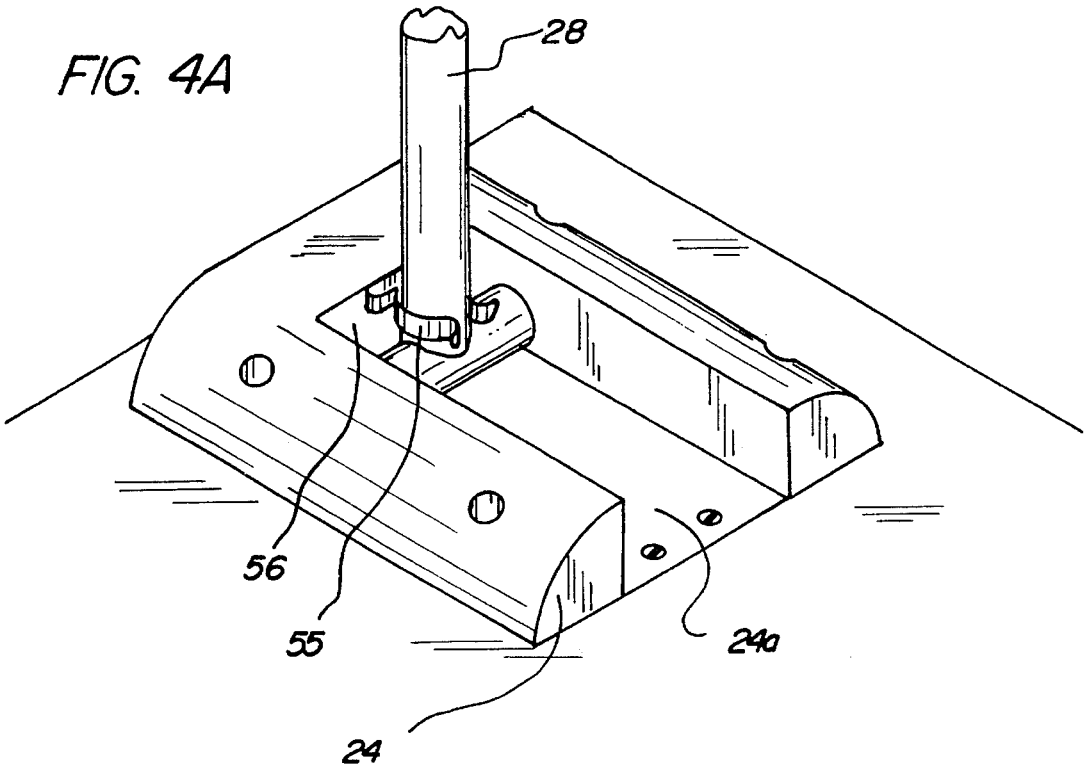
Figure 4B:
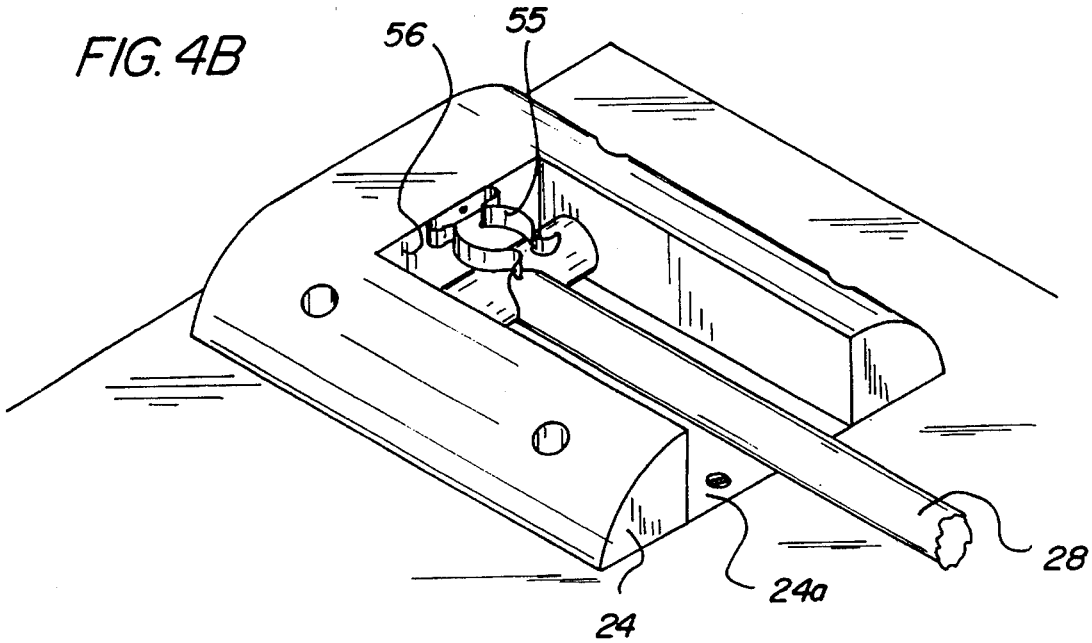

Respective first and second leg blocks 24 and 25 (see FIG. 3) are mounted in adjacency to the first end wall 14 along the bottom wall 13 and are mounted to the bottom wall in adjacency to the respective first and second side walls 16 and 17. Third and fourth leg blocks 26 and 27 are mounted to the bottom wall in spaced adjacency to the second end wall 15 and in adjacency to the respective first and second side walls 16 and 17. The first, second, third, and fourth leg blocks include respective first, second, third, and fourth leg rods 28, 29, 30, and 31 respectively, with each end of each first leg rod pivotally mounted within a respective leg receiving slot. The first leg rod 28 is pivotally mounted at its first end within a first leg receiving slot 24*a*, the second leg rod 29 is pivotally mounted at its first end within a second leg receiving slot 25*a*, a third leg receiving slot 26*a* pivotally mounts the first end of the third leg rod 30, while the fourth leg receiving slot 27*a* pivotally mounts the first end of the fourth leg rod 31. The first leg receiving slot 24*a* includes a slot rear wall 56 mounting a spring clip member 55, such that when the leg 28 is in a raised orientation, the spring clip maintains the leg and when in a lowered orientation, the leg is oriented below the spring clip to position the leg in the lowered orientation, such as indicated in FIG. 4*b* relative to the FIG. 4*a*. The first and third leg receiving slots 24*a* and 26*a* are arranged in a facing mirror image relationship relative to one another, while the second and fourth leg receiving slots 25*a* and 27*a* are arranged in a facing mirror image relationship relative to one another. First and second spring clips 33 and 34 are mounted in adjacency to the first and second slots 24*a* and 25*a* to receive the respective first and second legs 28 and 29 therewithin, wherein the legs are in a parallel relationship relative to the bottom wall 13, with third and fourth spring clips 35 and 36 mounted to the bottom wall in adjacency to the third and fourth slots 26*a* and 27*a* to receive the respective third and fourth legs 30 and 31 when the third and fourth legs are in a parallel folded and secured relationship relative to the bottom wall 13. A first flexible tether directed through the first and second legs, while a second flexible tether 39 is directed through the third and fourth legs. A support plate 36 mounted medially of the bottom wall includes a plate hook 37 for reception within a U-shaped mounting plate 40 for securement to a support vertical surface, such as indicated in FIG. 6, for receiving the hook 37.

A first winding axle 41 having a first winding axle head 42 is rotatably directed into the second side wall 17 in adjacency to the first end wall 14, with a second winding axle 43 having a second winding axle head 44 directed into the second side wall 17 in adjacency to the second end wall 15. To this end, the first winding axle 41 receives the first tether line 38 wound thereabout as the first tether line is fixedly secured to the second leg 29 and slidably received through the first leg 28. Similarly, the second winding axle 43 receives a second tether line 39 (see FIG. 8) as it is slidably directed through the third leg 30 and fixed to the fourth leg 31. The first axle 41 is spaced from the first end wall 14 a second spacing that is less than the first spacing oriented between the first and second legs relative to the first end wall. Similarly, the third and fourth legs are spaced from the second end wall 15 a third spacing which is greater than a fourth spacing from the second axle 43 to the second end wall. In this manner, upon winding of the respective tether lines about the axles, tensioning and maintaining of the legs in an extended orientation is effected, as illustrated in the FIGS. 7 and 8 for example.

An illumination bulb 45 is indicated for use by the apparatus 10*a*, as indicated in FIG. 8, to include an illumination bulb cover socket 46, having a primary fiber optic cable 47 having its cable first end 48 directed into the cover socket 46 in adjacency and communication with the bulb 45, such that illumination is directed through the primary fiber optic cable 47 projecting through the primary cable second end 49 into a cable socket 50, that in turn includes a plurality of secondary fiber optic cables 51 whose first ends are directed into the cable socket in communication with the primary cable second end 49. A plurality of transparent windows 52 are directed through the table top wall in adjacency to the door plates 21 for indication of such door plates, such that the second end of each of the fiber optic cables 51 is positioned in adjacency to a transparent window 52 for providing indication of orientation of the door plates. It should be understood that the windows 52 are coplanar with the table plate top wall 12 to provide an uninterrupted surface for use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable table apparatus, comprising, a table plate, having a plate top wall spaced from a plate bottom wall, a first-end wall spaced from a second end wall, a first side wall spaced from a second side wall, a table plate parallelepiped cavity directed into the table plate through the top wall, and a polymeric insert block complementarily and removably mounted within the parallelepiped cavity, with the insert block including an insert top wall, with a plurality of recess portions directed into the insert top wall, with each of the recess portions including a sliding door plate arranged for extension and retraction over a respective one of said recess portions, wherein each of the door plates is slidably received within a door plate slot, and each door plate slot is oriented parallel to and in adjacency to the insert top wall.

2. An apparatus as set forth in claim 1 wherein the insert block includes a ruler receiving slot directed into the insert block through the insert top wall.

3. An apparatus as set forth in claim 2 including a first leg block and a second leg block fixedly mounted to the plate bottom wall, with the first leg block including a first leg receiving slot, the second leg block having a second leg receiving slot, with the first leg block and the second leg block positioned in adjacency to the first end wall, and the first leg block positioned further in adjacency to the first side wall, with the second leg block positioned in adjacency to the second side wall, a third leg block positioned in adjacency to the second end wall and to the first side wall and mounted to the plate bottom wall, with a fourth leg block mounted to the plate bottom wall in adjacency to the second side wall and the second end wall, with the third leg block having a third leg receiving slot in a facing mirror image relationship relative to the first leg receiving slot, the fourth leg block having a fourth leg receiving slot in a mirror image facing relationship relative to the second leg receiving slot, a first leg having a first leg first end pivotally mounted within the first leg receiving slot, a second leg having a second leg first end pivotally mounted within the second leg receiving slot, a third leg having a third leg first end pivotally mounted within the third leg receiving slot, and a fourth leg having a fourth leg first end pivotally mounted within the fourth leg receiving slot, and a first flexible tether line mounted between the first leg and the second leg, and a second flexible tether line extending between and secured to the third leg and the fourth leg, with the first tether line directed in adjacency to the first leg second end and the second leg second end, the second tether line positioned in adjacency to the third leg second end and the fourth leg second end.

4. An apparatus as set forth in claim 3 wherein a first winding axle is directed into the second side wall, with the first winding axle having a first head, a second winding axle rotatably mounted within the second side wall, with the second winding axle having a second head, and the first tether line is fixedly secured to the second leg and slidably directed through the first leg and wound about the first winding axle, with the second tether line fixedly secured to the fourth leg and slidably directed through the third leg and wound about the second winding axle, with the first leg and the second leg spaced from the first end wall a first spacing, and the first winding axle spaced from the first end wall a second spacing, with the second spacing less than the first spacing, and the third leg and the fourth leg spaced from the second end wall a third spacing, and the fourth winding axle spaced from the second end wall a fourth spacing, with the fourth spacing less than the third spacing.

5. An apparatus as set forth in claim 4 including an illumination bulb arranged for selective illumination, and a cover socket arranged for positioning over the illumination bulb, and a primary fiber optic cable, the primary fiber optic cable including a primary cable first end and a primary cable second end, with the primary cable first end directed through the cover socket in adjacency to the illumination bulb, and a cable socket directed into the first end wall, with the primary cable second end arranged for reception within the cable socket, and a plurality of secondary fiber optic cables directed through the table plate, with each of the secondary fiber optic cables including a second cable first end directed into the cable socket in communication and adjacency to the primary cable second end, and a plurality of transparent windows directed into the table top wall, with each of said windows positioned in adjacency to one of said door plates, and each of the secondary fiber optic cables including a secondary cable second end positioned in adjacency to one of said transparent windows for indication and orientation of the door plates.

* * * * *